US005502913A

United States Patent [19]

Jackson

[11] Patent Number: 5,502,913

[45] Date of Patent: Apr. 2, 1996

[54] CARTRIDGE MAGAZINE FOR FIREARMS HAVING IMPROVED RETAINER

[75] Inventor: Terry R. Jackson, Bozeman, Mont.

[73] Assignee: Butler Creek Corporation, Belgrade, Mont.

[21] Appl. No.: 341,174

[22] Filed: Nov. 18, 1994

[51] Int. Cl.[6] ..... F41A 9/66; F41A 9/65

[52] U.S. Cl. ..... 42/50

[58] Field of Search ..... 42/50, 7; 89/33.1; 221/310, 312 B, 312 C

[56] References Cited

U.S. PATENT DOCUMENTS

| | | | |
|---|---|---|---|
| 303,992 | 8/1884 | Diss . | |
| 383,895 | 6/1888 | Mauser . | |
| 1,811,093 | 6/1931 | Neal . | |
| 1,890,388 | 12/1932 | Kramlik | 221/310 |
| 2,205,967 | 6/1940 | Wise . | |
| 2,409,568 | 10/1946 | Johnson, Jr. . | |
| 2,557,144 | 6/1951 | Schaich | 42/50 |
| 3,732,643 | 5/1973 | Wells . | |
| 3,890,729 | 6/1975 | Frisoli | 42/7 |
| 4,127,954 | 12/1978 | Hausmann | 42/50 |
| 4,152,857 | 5/1979 | Ketterer | 42/88 |
| 4,817,818 | 4/1989 | Lockhart | 221/1 |
| 4,970,818 | 11/1990 | Vecchieschi | 42/50 |
| 5,056,252 | 10/1991 | Velezis | 42/50 |
| 5,319,871 | 6/1994 | Racheli . | |

FOREIGN PATENT DOCUMENTS

| | | | |
|---|---|---|---|
| 79202 | 6/1950 | Czech Rep. | 42/50 |

*Primary Examiner*—Charles T. Jordan
*Assistant Examiner*—Christopher K. Montgomery
*Attorney, Agent, or Firm*—Cushman Darby & Cushman

[57] ABSTRACT

A cartridge magazine for use with a firearm includes a housing arranged to enclose a plurality of cartridges. The housing has an opened end and a mouth for permitting cartridges to be loaded therein and dispensed therefrom. A follower is movably positioned within the housing and biased toward the mouth. At least one movably mounted tongue and an opposing member are associated with the mouth. The movably mounted tongue is constructed and arranged to move between a first normally biased cartridge retaining position wherein a forward-most cartridge is retained in the mouth by the tongue and the opposing member and a second cartridge loading position wherein the movably mounted tongue is moved linearly away from the mouth as a new cartridge is inserted thereinto. The tongue thereafter returns to the first cartridge retaining position.

12 Claims, 4 Drawing Sheets

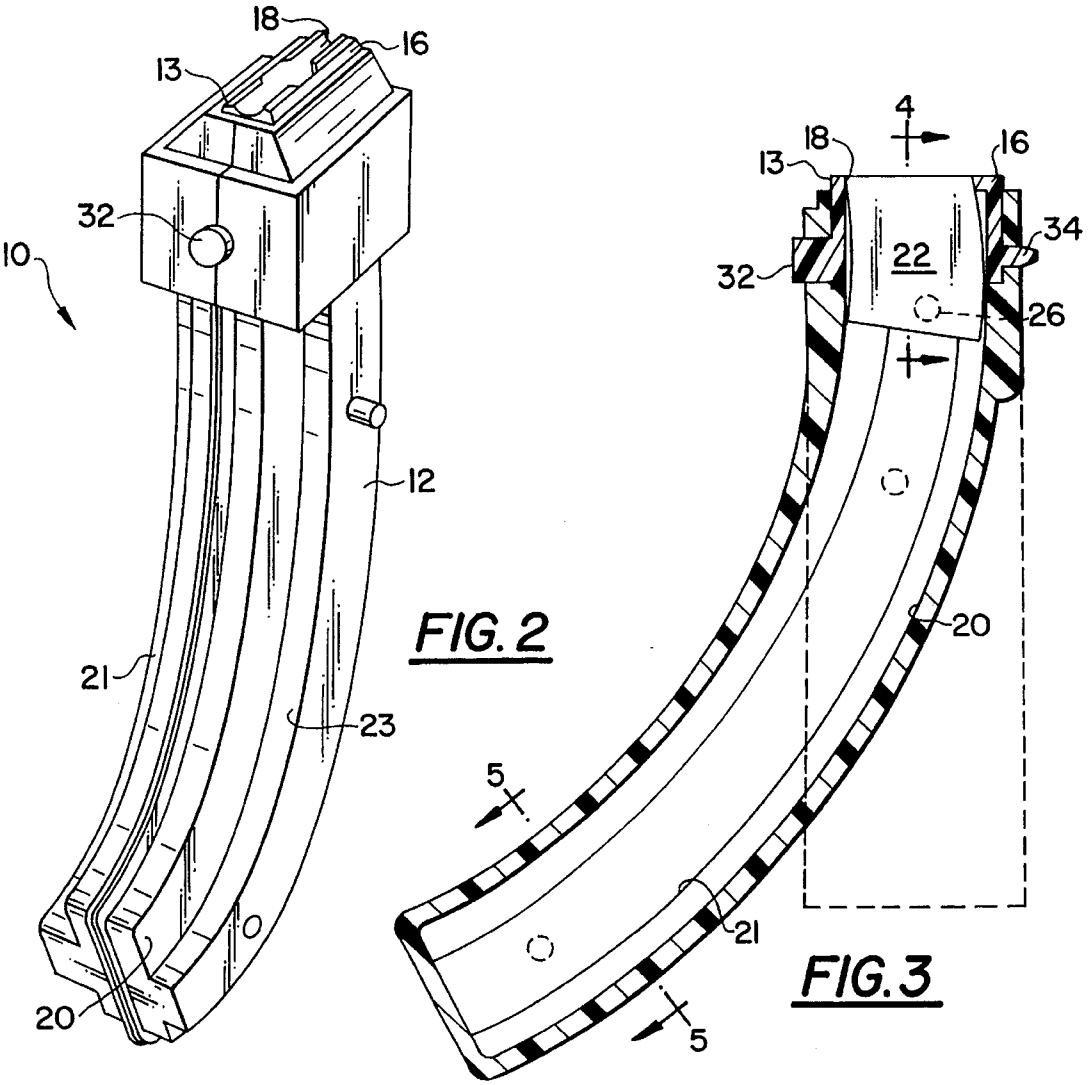
FIG. 2
FIG. 3
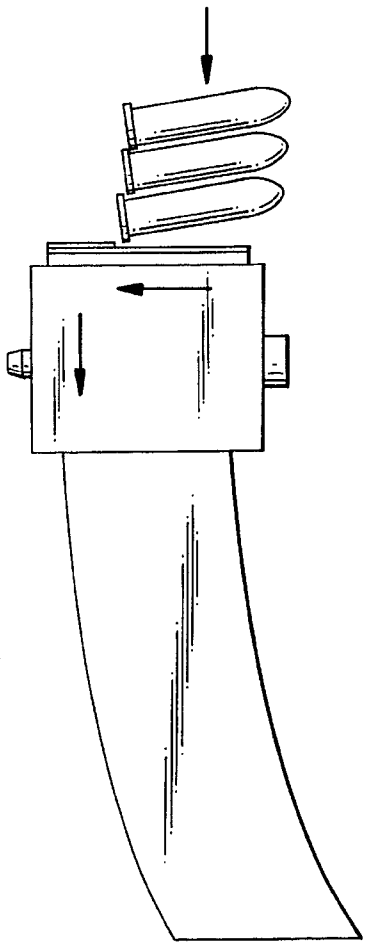
FIG. 1 (PRIOR ART)

CARTRIDGE MAGAZINE FOR FIREARMS HAVING IMPROVED RETAINER

BACKGROUND OF THE INVENTION

The present invention relates to cartridge magazines for firearms, and more particularly, to improvements in both loading and retaining a bullet or cartridge within the magazine.

Conventional cartridge magazines include a housing having a mouth for bullet entry at an end thereof, a follower moveable within the housing and a biasing structure for biasing the follower toward the mouth. The mouth of the housing is constructed and arranged to retain the bullets in the housing, under the bias applied thereto by the biasing structure yet allow access by the bolt structure to contact the forward-most cartridge and move it into the barrel for firing.

Magazines of this type are generally known in the art. One is described in U.S. Pat. No. 4,127,954. This magazine includes two opposing lips that are spaced apart defining a portion of a passageway. The lips overlie either side of the passageway and cartridge, yet are spaced a distance apart less than a diameter of the cartridge or bullet. The passageway further includes a channel sized to permit entry of the cartridge into the mouth. As shown in FIG. 1, such arrangement requires two distinct movements to load a cartridge into the magazine. First, the cartridge is introduced at an angle into the channel with sufficient force so as to overcome the bias of the biasing structure. Next, the cartridge is then moved forward under the lips of the mouth such that the lips retain the cartridge within the mouth, against the bias of the biasing structure.

These magazines suffer from the drawback that the loading of the cartridges requires several distinct cartridge movements and is difficult, thereby requiring a certain skill, since the cartridges cannot be directly introduced through the lips and retained in the mouth of the magazine.

To obviate the above mentioned drawback, a device has been proposed to permit a cartridge to be introduced into the mouth of the magazine upon a single movement and thereafter be retained within the housing against the bias of the biasing structure. Such device is disclosed in U.S. Pat. No. 4,970,818 which includes a spring member and a pawl. The pawl is pivotally coupled to the mouth opening so as to rotate between a bullet retaining position and a bullet entry position. However, this device suffers from the drawback that the pawl and spring member are disposed on an exposed outer surface of the housing near the mouth and are susceptible to damage due to mishandling of the device.

SUMMARY OF THE INVENTION

One object of the invention is to provide a magazine for firearms which has a mouth that permits cartridges to be introduced by a single longitudinal movement with the inserted cartridges being retained therein by a movable tongue. The tongue is constructed and arranged within the mouth of the housing to hold the forward-most cartridge yet reduce the likelihood of damage to the mouth or the tongue due to mishandling of the magazine.

In accordance with the principles of the present invention, this object is achieved by providing the magazine with a housing arranged to enclose a plurality of cartridges. The housing has an opened end defining a mouth for permitting cartridges to be located therein and dispensed therefrom.

The opened end includes at least one movable tongue and an opposing member which permit both the receipt of and withdrawal of cartridges. A follower is movable within the housing and is normally biased toward the mouth.

The tongue is constructed and arranged to move between a first, normally biased cartridge retaining position, wherein a forward-most cartridge is retained in the mouth, and a second, cartridge loading position, wherein the tongue is moved progressively away from the mouth as a new cartridge is inserted thereinto. That movement is preferably linear but other movements are understood to be included. The tongue thereafter returns to the first cartridge retaining position.

Other objects, features and characteristics of the present invention, as well as the methods of operation and functions of the related elements of the structure, and the combination of parts and economies of manufacture, will become more apparent upon consideration of the following detailed description and appended claims with reference to the accompanying drawings, all of which form a part of the specification.

BRIEF DESCRIPTION OF THE DRAWINGS

FIG. 1 is a schematic illustration of a conventional magazine showing the required movements of cartridges during loading;

FIG. 2 is a perspective illustration of a cartridge magazine provided in accordance with the principles of the present invention;

FIG. 3 is a side view in section of the cartridge magazine of FIG. 2;

DETAILED DESCRIPTION OF THE PREFERRED EMBODIMENT

Figure 4:
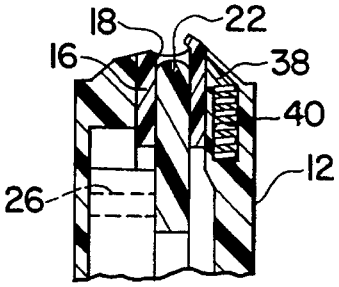
FIG. 4 is a detailed sectional view taken along the line 4—4 of FIG. 3.
Figure 5:
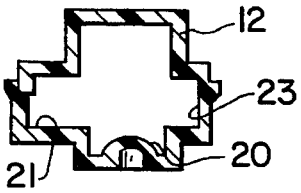
FIG. 5 is a detailed sectional view taken along the line 5—5 of FIG. 3.
Figure 6:
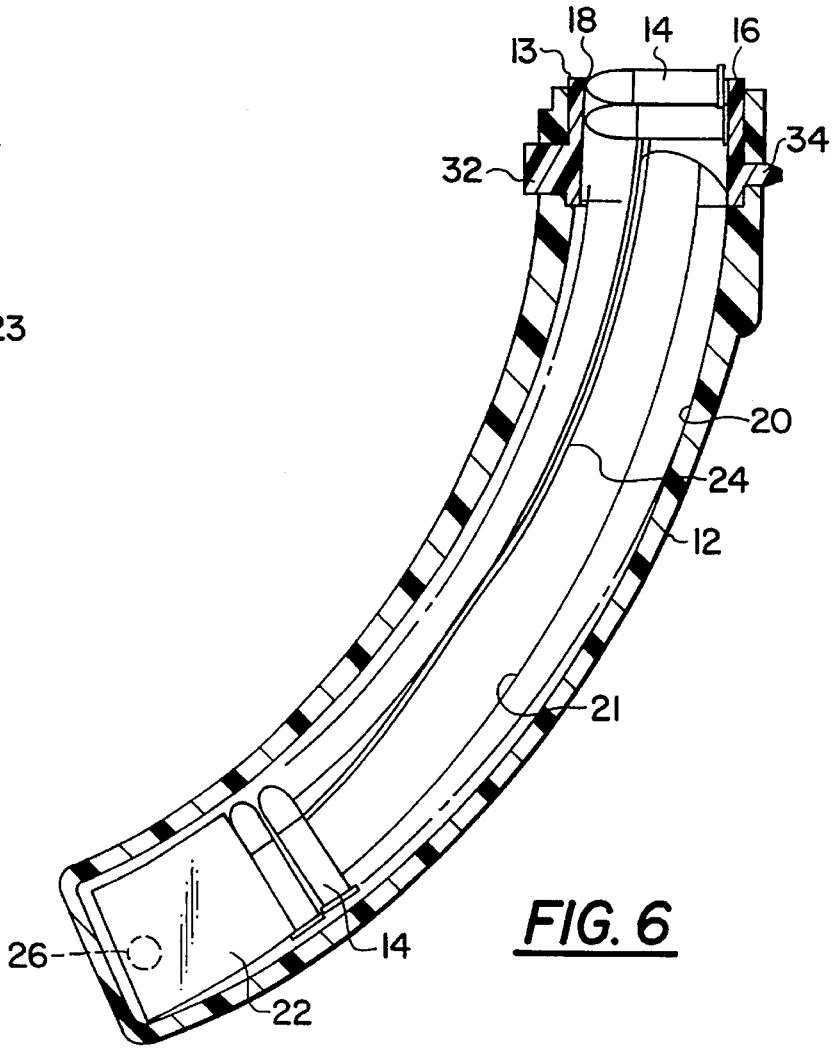
FIG. 6 is a sectional view of the cartridge magazine shown in FIG. 3 with the cartridges therein.

A magazine 10 in accordance with the present invention for holding cartridges for use with a firearm is shown in FIGS. 2 through 6. As shown in FIG. 2, the magazine 10 comprises a housing 12 constructed and arranged to enclose a plurality of cartridges 14 (FIG. 6). The housing 12, formed by attaching two molded halves together such as by heat sealing or adhesives, has an opened end 13 and a mouth 18 defined by a retainer 16 housed therein. The mouth 18 therein is configured such that a cartridge is permitted to be located therein and dispensed therefrom. As shown, housing 12 can be arcuate in plan form to conform to a stacking arc of the plurality of cartridges 14 housed therein. However, housing 12 could be straight with the follower structure being shaped to accommodate the arc associated with the cartridges, (see dotted lines in FIG. 3) for example, as disclosed in U.S. Pat. No. 5,113,604, the disclosure of which is hereby incorporated into the present specification. Thus, when a number of cartridges are being received, the follower and housing would be shaped accordingly.

As shown in FIG. 5, the housing 12 is constructed and arranged to define an interior groove 20. A follower 22 is slidably received within the groove 20 and is held in a biased home or up position as in FIG. 3. When slid to the bottom, as in FIG. 6, the coil spring 24 will be extended in an interior groove 21. The movement of the follower 22 is controlled by a guide pin 26 which moves within the groove 20. The spirally wound spring 24 is secured at the free end thereof to the upper end of the housing 12. The other end of the spring 24 is coiled around a pin 26 so that the coil can unroll. Pin 26 is part of follower 22. The housing 12, follower 22, and spring 24 are of the type disclosed in U.S. Pat. No. 4,127,954, the disclosure of which is hereby incorporated into the present specification. A groove 23 is disposed opposite groove 21 in the illustrated embodiment, as shown in FIG. 5. However, groove 23 need not be provided.

With reference to FIG. 3, the bias of the spring 24 advances the follower 22 toward the mouth 18 of the cartridge magazine 10. Due to the bias of the follower 22, the cartridges are advanced toward the mouth 18 in the retainer 16, as shown in FIG. 7.

It can be appreciated that the housing 12 can be of any configuration suitable for enclosing a plurality of cartridges 14. Further, although in the illustrated embodiment, the biasing structure is a spirally wound spring 24, other springs may be used to bias a follower 22 toward the mouth 18 in the retainer 16. For example, coil springs, leaf springs or other springs constructed and arranged to bias the follower 22 may be used.

In accordance with the invention, the retainer, generally indicated at 16, is disposed within the open end 13 of the housing 12 and defines a mouth 18. The retainer 16 may be formed of plastic or metal. In the illustrated embodiment, the retainer 16 is coupled to the housing 12 via opposed projecting posts 32 and 34 which are each received in a corresponding hole in the housing 12. In the illustrated embodiment, the retainer 16 is separately formed from the housing 12. However, it can be appreciated that the retainer may be integrally formed whole or in part with the housing 12.

Figure 7:
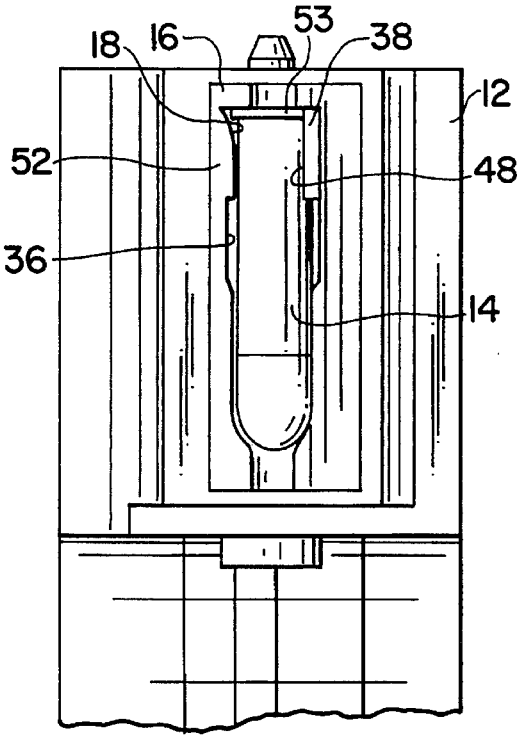
FIG. 7 is an enlarged end view of the mouth of the cartridge magazine provided in accordance with the present invention.

As shown in FIG. 7, the retainer 16 includes a channel 36 disposed generally in a central portion thereof, which facilitates unloading of the magazine 10 when the magazine 10 is coupled to a firearm, as will be explained below. The retainer 16 further includes a slot 37 communicating with mouth 18, and disposed at an angle A which can vary from ten to seventy-five degrees, but is preferably in the range of twenty-five to thirty-five degrees. In the illustrated embodiment, angle A is twenty-eight degrees with respect to a longitudinal axis of the retainer 16 (FIG. 8).

Figure 8:
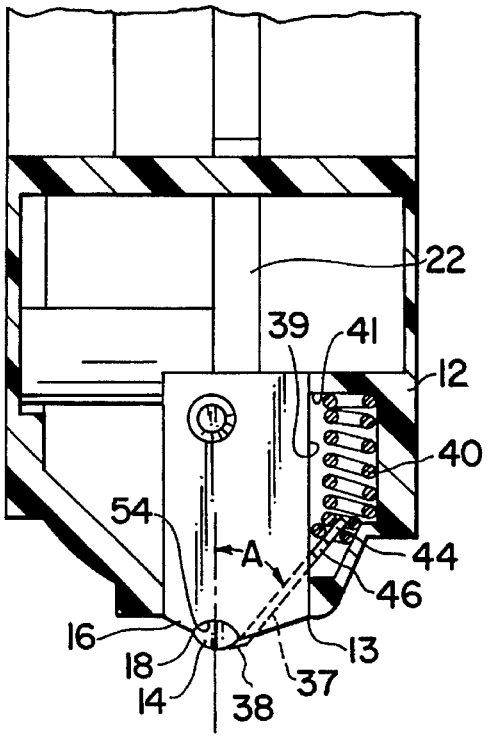
FIG. 8 is an enlarged plan view, shown partially in section, of the mouth and a portion of the cartridge magazine.
Figure 9:
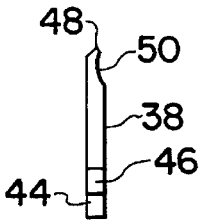
FIG. 9 is a side view of a moveable tongue disposed in the mouth.
Figure 10:
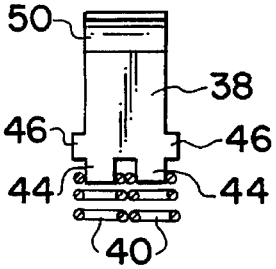
FIG. 10 is a plan view of the moveable tongue of FIG. 9.

With reference to FIGS. 7 and 8, the retainer 16 includes a movably mounted member or tongue 38 which is mounted for reciprocating movement within the slot 37. The movably mounted member 38 may be formed of plastic or metal. As shown in FIG. 8, the movably mounted member 38 is normally biased into the mouth 18 by at least one spring 40. In the illustrated embodiment, a pair of springs 40 are provided (FIG. 10). One end of each spring 40 is engaged with a surface 41 of the housing 12 while the other end thereof is coupled to a distal end of the movably mounted member 38. Thus, in a normally biased position, the movably mounted member 38 extends into the mouth 18.

With reference to FIGS. 7 and 10, the movably mounted member 38 includes a proximal and a distal end 51 and 55, respectively. The distal end 55 includes two spaced protruding members 44, each arranged to receive a spring 40. Extending members 46 protrude from the side surfaces of the movably mounted member 38 so as to define a stop which engages with surface 39 of the retainer 16 when the movably mounted member 38 is in its normally biased position (FIG. 8). The proximal end 51 of the movably mounted member 38 terminates in a lip 48 and includes a camming surface 50, the function of which will become apparent below.

As shown in FIG. 7, a fixed opposing member 52, disposed opposite the movably mounted member 38, extends into the mouth 18. The spacing between the opposing member 52 and the lip 48 of the movably mounted member 38, in its biased state, is less than the cartridge diameter. Thus, the lip 48 and opposing member 52 cooperate to retain the forward-most cartridge 14 in the retainer 16, against the bias of spring 24.

As shown in FIG. 8, the retainer 16 includes a notch 54 so as to expose a proximal end of the cartridge 14 for removal by forward movement thereof such that the rim 53 of the cartridge moves along camming surface 50 and beyond lip 48 and fixed member 52, until the cartridge 14 reaches the channel 36 and is dispensed therefrom.

Figure 11:
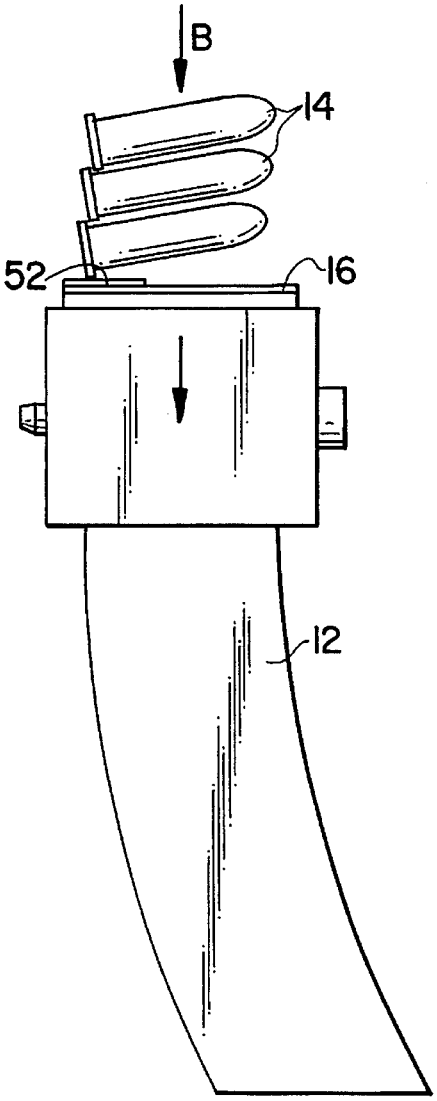
FIG. 11 is a schematic illustration similar to FIG. 1, showing the direction of insertion of cartridges into the magazine of the present invention.

The operation of the retainer 16 will be appreciated below. The movably mounted member 38 is constructed and arranged to move between a normally biased cartridge retaining position wherein a forward-most cartridge is retained in the mouth 18 of the retainer 16 (FIGS. 7 and 8), and a cartridge loading position wherein the movably mounted member 38 is moved linearly away from the mouth 18 as a new cartridge 14 is inserted thereinto. Thereafter, the movably mounted member 38 returns to its cartridge retaining position to retain the new cartridge in the mouth 18. When a new cartridge is inserted into the retainer 16, manual movement of the cartridge 14 in the direction shown by arrow B in FIG. 11 biases the movably mounted member 38 linearly away from the mouth 18 compressing springs 40 thereby permitting the opening of the mouth 18 to widen and receive the cartridge 14. Thus, once the cartridge 14 has been inserted into the mouth 18 past lip 48 of the movably mounted member 38, the springs 40 bias the movably mounted member 38 back into the mouth 18 such that the cartridge 14 is retained in the mouth 18, since the bias of the follower 22 forces the rim 53 and body of the forward-most cartridge 14 against the lip 48 of the movably mounted member 38 and against the opposing member 52.

Thus, it can be appreciated that the retainer 16 of the cartridge magazine 10 of the invention provides an easy an effective way to load the magazine in a single movement in a longitudinal direction of the housing 12 of the magazine, with the cartridges 14 being reliably retained. Further, since the movably mounted member 38 is mounted in the retainer 16 so as to be movable linearly toward and away from the mouth 18 of the retainer 16, there is less likelihood that the movably mounted member 38 will be damaged by mishandling of the magazine 10.

Figure 12:
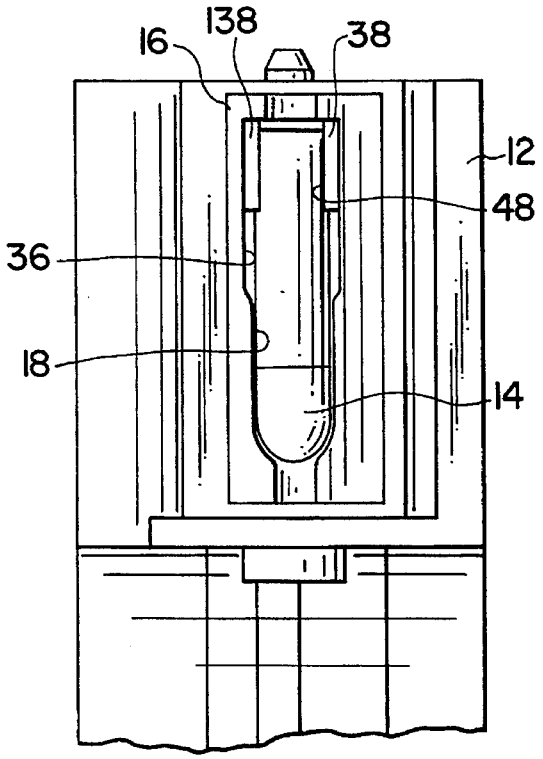
FIG. 12 is an enlarged end view of the mouth of the cartridge magazine provided in accordance with a second embodiment of the invention, showing opposing moveable tongues.

In the illustrated embodiment, one movably mounted member 38 is provided together with a cooperating fixed opposing member 52. However, as shown in FIG. 12, the fixed opposing member may be replaced with a second movably mounted member 138 and associated springs. Thus, it is within the contemplation of the invention to provide opposing movably mounted members 38 and 138 which may be moved linearly away from the mouth 18 when a cartridge 14 is inserted, and thereafter, return to a cartridge retaining position in the manner described above.

While the invention has been described in connection with what is considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A cartridge magazine for use with a firearm comprising:

a housing arranged to enclose a plurality of cartridges, said housing having an opened end defining a mouth for permitting cartridges to be loaded therein and dispensed therefrom;

a follower movably positioned within said housing and biased toward said mouth; and at least one movably mounted tongue and an opposing member associated with the mouth, said movably mounted tongue being constructed and arranged to move between a first normally biased cartridge retaining position wherein a forward-most cartridge is retained in said mouth by said tongue and said opposing member and a second cartridge loading position wherein said movably mounted tongue is moved linearly away from said mouth as a new cartridge is inserted thereinto, said tongue thereafter returning to the first cartridge retaining position.

2. The cartridge magazine according to claim 1, wherein said tongue is normally biased to its first cartridge retaining position by at least one spring, said at least one spring being constructed and arranged with respect to said tongue and said housing such that as the new cartridge is inserted into the mouth, said tongue moves linearly against the bias of said at least one spring.

3. The cartridge magazine according to claim 2, wherein a pair of springs normally bias said tongue to its first cartridge retaining position.

4. The cartridge magazine according to claim 1, wherein said housing includes a retainer mounted in said opened end thereof, said retainer defining said mouth and including a slot communicating with said mouth, said tongue being mounted for movement between its first cartridge retaining position and its second cartridge loading position within said slot.

5. The cartridge magazine according to claim 4, wherein said tongue includes a proximal and a distal end, said distal end being constructed and arranged to cooperate with said at least one spring, said proximal end terminating in a lip and including a camming surface.

6. The cartridge magazine according to claim 5, wherein said opposing member is a fixed member integrally formed with said retainer such that a distance between the fixed member and the lip of said tongue is less than a diameter of a cartridge, when said tongue is disposed in its first, cartridge retaining position.

7. The cartridge magazine according to claim 6, wherein said retainer includes a notch at one end thereof extending transverse to said mouth so as to expose an end of the forward-most cartridge to be accessed and removed from the retainer upon forward movement thereof along the camming surface and beyond the lip and fixed member.

8. The cartridge magazine according to claim 1, wherein said opposing member is a second movably mounted tongue, each movably mounted tongue being constructed and arranged to move between a first normally biased cartridge retaining position wherein a forward-most cartridge is retained in said mouth by said tongues and a second cartridge loading position wherein said movably mounted tongues are moved linearly away from said mouth as a new cartridge is inserted into thereinto, said tongues thereafter returning to the first cartridge retaining position.

9. The cartridge magazine according to claim 4, wherein said slot is disposed at an angle in the range of ten degrees to seventy-five degrees with respect to a longitudinal axis of the mouth.

10. The cartridge magazine according to claim 9, wherein said angle is approximately twenty-eight degrees.

11. The cartridge magazine according to claim 1, wherein said tongue is formed of one of plastic and metal.

12. The cartridge magazine according to claim 1, in combination with a plurality of cartridges, said tongue contacting a rim and body of the forward-most cartridge when in its first cartridge retaining position.

* * * * *